US011422578B2

(12) United States Patent
Liu et al.

(10) Patent No.: US 11,422,578 B2
(45) Date of Patent: Aug. 23, 2022

(54) PARALLEL LOW DROPOUT REGULATOR

(71) Applicant: NXP B.V., Eindhoven (NL)

(72) Inventors: Xiaoqun Liu, Chandler, AZ (US); Madan Mohan Reddy Vemula, Tempe, AZ (US); Mohammad Nizam Kabir, Tempe, AZ (US)

(73) Assignee: NXP B.V., Eindhoven (NL)

( * ) Notice: Subject to any disclaimer, the term of this patent is extended or adjusted under 35 U.S.C. 154(b) by 142 days.

(21) Appl. No.: 16/860,887

(22) Filed: Apr. 28, 2020

(65) Prior Publication Data

US 2021/0333812 A1 Oct. 28, 2021

(51) Int. Cl.

| | |
|---|---|
| ***G05F 1/563*** | (2006.01) |
| ***G05F 1/571*** | (2006.01) |
| ***G05F 1/575*** | (2006.01) |
| ***G05F 1/59*** | (2006.01) |
| ***G05F 1/46*** | (2006.01) |

(52) U.S. Cl.

CPC ..... *G05F 1/563* (2013.01); *G05F 1/468* (2013.01); *G05F 1/571* (2013.01); *G05F 1/575* (2013.01); *G05F 1/59* (2013.01)

(58) Field of Classification Search

CPC ..... G05F 1/563; G05F 1/468; G05F 1/571; G05F 1/575; G05F 1/59

See application file for complete search history.

(56) References Cited

U.S. PATENT DOCUMENTS

| | | | | |
|---|---|---|---|---|
| 7,821,240 | B2 * | 10/2010 | Oddoart | G05F 1/565 323/269 |
| 9,870,014 | B1 * | 1/2018 | Ham | G05F 1/625 |
| 10,222,818 | B1 | 3/2019 | Lin | |
| 2007/0055896 | A1 * | 3/2007 | Er | G06F 1/26 713/300 |
| 2012/0194151 | A1 | 8/2012 | Gunther et al. | |
| 2020/0042026 | A1 | 2/2020 | Wang et al. | |

FOREIGN PATENT DOCUMENTS

| | | |
|---|---|---|
| CN | 203027231 U | 6/2013 |
| CN | 103838284 A | 6/2014 |

OTHER PUBLICATIONS

Vaisband, Inna et al; "Stability of Distributed Power Delivery Systems with Multiple Parallel On-Chip LDO Regulators"; IEEE Transactions on Power Electronics, vol. 31, Issue 8; 10 pages (Aug. 2016).

* cited by examiner

*Primary Examiner* — Jue Zhang

(57) ABSTRACT

A low dropout regulator includes a first stage that generate a first output voltage and a second stage that generates a second output voltage different from the first output voltage. The first stage and the second stage are coupled in parallel to a node, the stages are selectively controlled respective first and second output signals based on different conditions. One condition may be operation of a load in one or more predetermined modes. Another condition may be transition between modes. Selective control of the first stage during a mode transition may reduce voltage undershoot or voltage overshoot in the load.

19 Claims, 8 Drawing Sheets

PARALLEL LOW DROPOUT REGULATOR

Example embodiments disclosed herein relate generally to voltage regulation.

BACKGROUND

A low-dropout (LDO) regulator generates a direct current (DC) output voltage from an input supply voltage. This type of regulator is used in many applications because of its ability to linearly regulate output voltage, even when the supply voltage is very close to the output voltage. Also, LDOs tend to generate less noise and may be smaller than other types of regulators.

SUMMARY

A summary of various exemplary embodiments is presented below. Some simplifications and omissions may be made in the following summary, which is intended to highlight and introduce some aspects of the various exemplary embodiments, but not to limit the scope of the invention. Detailed descriptions of an exemplary embodiment adequate to allow those of ordinary skill in the art to make and use the inventive concepts will follow in later sections.

Various embodiments relate to a low dropout regulator, including: a first stage configured to generate a first output voltage; and a second stage configured to generate a second output voltage different from the first output voltage, wherein the first stage and the second stage are coupled in parallel to a node, the first stage configured to be selectively controlled to generate the first output voltage based on a first condition and the second stage configured to be selectively controlled to generate the second output voltage based on a second condition different from the first condition, and wherein the second output voltage is reduced during mode transition so that the first output voltage is greater than the second output voltage.

Various embodiments are described, wherein the first output voltage is in a range that reduces voltage overshoot in a signal output from the node.

Various embodiments are described, wherein the first output voltage is in a range that reduces voltage undershoot in a signal output from the node.

Various embodiments are described, wherein: the first condition includes a transition between a first mode and a second mode of a load coupled to the node, and the second condition includes operation of the load during at least one of the first mode and the second mode.

Various embodiments are described, wherein: the first stage is configured to be selectively controlled to generate the first output voltage during the transition based on a first set of control signal values, and the second stage is configured to be selectively controlled to generate the second output voltage during each of the first mode and the second mode based on a second set of control signal values.

Various embodiments are described, wherein the first mode and the second mode correspond to different operational modes of a load.

Various embodiments are described, wherein at least one of the first mode and the second mode is a reduced power mode.

Various embodiments are described, wherein: the first stage is configured to operate at a first speed and based on a first quiescent current, and the second stage is configured to operate at a second speed and based on a second quiescent current, the first speed different from the second speed and the first quiescent current different from the second quiescent current.

Various embodiments are described, wherein: the first speed is greater than the second speed, and the first quiescent current is greater than the second quiescent current.

Various embodiments are described, wherein the first stage includes a soft shutdown circuit which is configured to reduce a level of the first output voltage based on operation of the second stage.

Further various embodiments relate to an apparatus for controlling the low dropout voltage (LDO) regulator including a first stage and a second stage, the first state and the second stage coupled to an output node, the apparatus including: a memory configured to store instructions; and a processor configured to execute the instructions to generate: one or more first control signals to cause the first stage to generate a first output voltage based on a first condition, one or more second control signals to cause the second stage to generate a second output voltage based on a second condition, wherein the second output voltage different from the first output voltage and wherein the second output voltage is reduced during mode transition so that the first output voltage is greater than the second output voltage.

Various embodiments are described, wherein the first output voltage is in a range that reduces voltage overshoot in a signal output from the node.

Various embodiments are described, wherein the first output voltage is in a range that reduces voltage undershoot in a signal output from the node.

Various embodiments are described, wherein: the first condition includes a transition between a first mode and a second mode of a load coupled to the node, and the second condition includes operation of the load during at least one of the first mode and the second mode.

Various embodiments are described, wherein: the one or more first control signals control the first stage to generate the first output voltage during the transition, and the one or more second control signals control the second stage to generate the second output voltage during each of the first mode and the second mode.

Various embodiments are described, wherein the first mode and the second mode correspond to different operational modes of a load.

Various embodiments are described, wherein at least one of the first mode and the second mode is a reduced power mode.

Various embodiments are described, wherein: the first stage is configured to operate at a first speed and based on a first quiescent current, and the second stage is configured to operate at a second speed and based on a second quiescent current, the first speed different from the second speed and the first quiescent current different from the second quiescent current.

Various embodiments are described, wherein: the first speed is greater than the second speed, and the first quiescent current is greater than the second quiescent current.

Various embodiments are described, wherein the processor is configured to generate control signals for controlling a soft shutdown circuit of the first stage.

BRIEF DESCRIPTION OF THE DRAWINGS

Additional objects and features of the invention will be more readily apparent from the following detailed description and appended claims when taken in conjunction with the drawings. Although several example embodiments are illustrated and described, like reference numerals identify like parts in each of the figures, in which:

DETAILED DESCRIPTION

Figure 1:
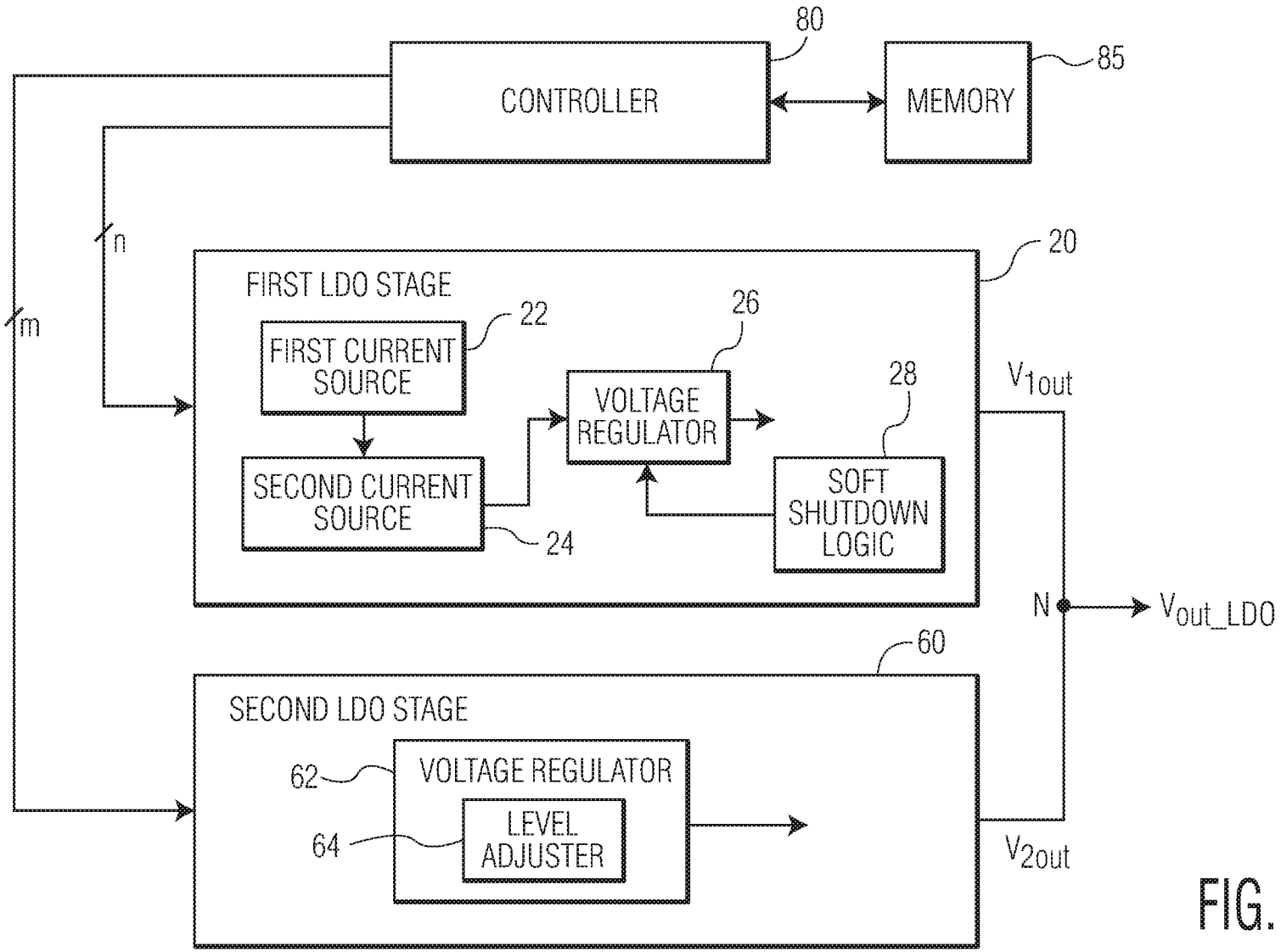
FIG. 1 illustrates an embodiment of a low dropout regulator.

It should be understood that the figures are merely schematic and are not drawn to scale. It should also be understood that the same reference numerals are used throughout the figures to indicate the same or similar parts.

The descriptions and drawings illustrate the principles of various example embodiments. It will thus be appreciated that those skilled in the art will be able to devise various arrangements that, although not explicitly described or shown herein, embody the principles of the invention and are included within its scope. Furthermore, all examples recited herein are principally intended expressly to be for pedagogical purposes to aid the reader in understanding the principles of the invention and the concepts contributed by the inventor(s) to furthering the art and are to be construed as being without limitation to such specifically recited examples and conditions. Additionally, the term, "or," as used herein, refers to a non-exclusive or (i.e., and/or), unless otherwise indicated (e.g., "or else" or "or in the alternative"). Also, the various example embodiments described herein are not necessarily mutually exclusive, as some example embodiments can be combined with one or more other example embodiments to form new example embodiments. Descriptors such as "first," "second," "third," etc., are not meant to limit the order of elements discussed, are used to distinguish one element from the next, and are generally interchangeable. Values such as maximum or minimum may be predetermined and set to different values based on the application.

In one application, an LDO regulator is used to provide power for multiple modes of operation of a host device. In these cases, the LDO regulator is also required to provide power during transitions between modes. Often, the operational modes consume different levels of current. In order to meet these requirements, the LDO regulator must output a proportional load current. However, during transitions between modes, the load current value may change significantly, for example, from 1 mA to 3 mA or even a greater amount. Also, the change in load current value may occur very fast, for example, within a few nS.

In an attempt to address the problems that occur during mode transition, some LDO regulators are designed to have very low quiescent current in order to limit the total current consumption of the host system. LDOs have been designed this way, for example, in order to support the requirements of the host system when operating in sleep and other low-power states. During these states, quiescent current of the LDO may be required to be much lower than a few uA because the total current consumption of host system may be required to be less than a few uA while the LDO is still turned on. Such low current significantly limits the speed of the LDO regulator to levels below those required operate at a speed sufficient to respond to the large and fast changes of load current that take place during mode transitions of the host system, that is changing from a current mode to a low current mode for from a low current mode to a high current mode.

LDO regulators in use today also suffer from voltage overshoot or undershoot during mode transitions of the host system. This may have a serious effect on system performance, for example, by creating failures or other disruptive malfunctions. In some cases, overshoot or undershoot of voltage may trigger over/under voltage detection, which, in turn, may trigger reset of the system. In addition, voltage overshoot may damage the host system.

FIG. 1 illustrates an embodiment of a low dropout (LDO) regulator including a parallel arrangement of a first LDO stage 20 and a second LDO stage 60. The first and second LDO stages are selectively controlled to output different levels of output voltages to a common node N, from which the output voltage ($V_{out_LDO}$) of the low dropout regulator is generated. In addition to different output voltage levels, the first and second LDO stages may have different quiescent currents. The LDO stages may be selectively enabled or otherwise controlled based on one or more control signals, generated by a controller 80, in order to output their respective voltages during various periods of operation of a load, which, for example, may be a host system.

The LDO regulator and controller may be on a same chip or printed circuit board. In one embodiment, controller 80 may be within the same host system as the LDO regulator but may be provided separately and communicatively coupled to the LDO regulator. Also, in other embodiments, one or more additional LDO stages may be connected in parallel with stages 20 and 60, for example, in order to provide additional levels of output voltage for one or more intended applications.

Referring to FIG. 1, the first LDO stage 20 operates at a first speed level and with a first quiescent current. The second LDO stage 60 operates at a second speed level and with a second quiescent current. The first speed level may be different from the second speed level. For example, the first speed level may be greater than the second speed level. Also, the first quiescent current may be different from the second quiescent current. For example, the first quiescent current may be greater than the second quiescent current. The speed level and current may correspond, for example, to predetermined values that satisfy that requirements of different operational modes of a load (e.g., host system) which includes or is coupled to the LDO regulator.

The controller 80 may generate one or more first control signals for selectively enabling a first combination of the LDO stages 20 and 60. The first combination of LDO stages may be selectively enabled, for example, based on a first predetermined condition. The first predetermined condition may be based on the operating mode of the host system, a transition between two operating modes of the host system, and/or one or more other conditions relating to operation and/or requirements of an application executed by the host system. The first combination of LDO stages may correspond to operation of at least one of the stages.

In one embodiment, when the host system is operating in one or more modes, the controller 80 may generate the first control signals to disable the first LDO stage 20 and enable the second LDO stage 60. As previously indicated, the first LDO stage 20 may be a high-speed, high quiescent current LDO stage and the second LDO stage 60 may be low-speed, low-quiescent current LDO stage. Configuring the LDO stages in this manner may satisfy a low-power requirement of the host system during the first operational mode. The one or more first modes may include, for example, at least one of a normal operating mode and a reduced-power state (e.g., sleep state, hibernate state, or other low-power state) of the host system or other type of load.

The controller 80 generates a set of second control signals for selectively enabling a second combination of the LDO stages 20 and 60. The second combination of LDO stages may be selectively enabled, for example, based on a second predetermined condition. The second predetermined condition may be based, for example, on a different one of the operating modes of the host system, a transition between two operating modes of the host system, and/or one or more other conditions relating to the operational state and/or requirements of an application executed by the host system. The second combination of LDO stages may correspond to operation of at least one of the stages.

In one embodiment, the second predetermined condition includes a transition of the host system from a first mode to a second mode. This may involve, for example, transitioning from a normal operational mode to a low-power mode, from a low-power mode to a normal operational mode, or between low-power modes or any two other modes of the host system. The second control signals may be generated, for example, just before the transition between modes is to take place, e.g., at a time when controller 80 determines that a mode transition is to be performed. The controller 80 may make this determination based on instructions from the host system and/or instructions stored in a non-transitory computer-readable medium 85 and executed by controller 80.

The controller 80 may generate the second control signals to enable at least the first LDO stage 60. In one embodiment, the second control signals may enable both the first LDO stage 20 and the second LDO stage 60 at the same time during the transition period when the mode change occurs, although in one embodiment a scale down (or in some cases even a shutdown) operation may be performed for the second LDO stage during this transitional period. Turning on the first LDO stage 20 or both LDO stages during the period of transition between modes adjusts the response speed and output current level of the LDO regulator in a manner that reduces voltage undershoot and a voltage overshoot (or prevents these conditions from occurring altogether) as a result of the mode transition.

In one embodiment, the response speed and the output current level of the LDO regulator may be increased so that the output voltage ($V_{out_LDO}$) of the regulator falls within a range sufficient to prevent voltage overshoot and voltage undershoot from occurring. While simultaneously enabling both LDO stages at this time may temporarily increase power consumption (e.g., during the mode transition period), the benefit of preventing voltage overshoot and undershoot (which may adversely affect performance of, or even damage, the host system) outweighs these considerations.

After mode transition has been completed, the controller 80 may generate the set of first control signals once again in order to disable the first LDO stage 20 and enable the second LDO stage 60, for example, in order to maintain low power consumption in normal or a reduced power mode. In one embodiment, generation of the second control signals under these circumstances may optionally be performed after a settling time succeeding the mode transition period. Selectively enabling (e.g., enabling and/or disabling selected ones of) the first LDO stage 20 and the second LDO stage 60 may be performed based on corresponding n and m control signals, where n≥1 and m≥1. The numbers m and n may be the same or different. Each of the set of first control signals and the set of second control signals may include one or more control signals.

The first LDO stage 20 may include a first current source 22, a second current source 24, a voltage regulator 26, and optional soft shutdown logic 28. In operation, the controller 80 generates one or more control signals for coupling the first current source to the second current source. The output of the second current source may be input into the voltage regulator, and the voltage regulator may then generate a first output voltage ($V_{1out}$) during one or more mode transition periods. The optional soft shutdown logic may disable the output of the voltage regulator 26 based on one or more predetermined conditions, as discussed in detail below. Because the first LDO stage 20 generates the first output voltage at a time when the second output voltage is not output (or has been scaled down), voltage overshoot and/or undershoot is reduced or prevented from occurring and a stable output voltage is output from the LDO regulator during mode transition periods.

The second LDO stage 60 may include a voltage regulator 62 with an optional adjuster 64 coupled to the output node of the LDO regulator. The voltage regulator 62 may be a closed-loop regulator or an open-loop regulator for generating a second output voltage of a desired level. The output voltage ($V_{2out}$) may be generated by passing through, or regulating, a power supply voltage received from one or more voltage sources (e.g., located in the host system). The adjuster 64 may adjust the level of the second output voltage $V_{2out}$ to one of a plurality of desired voltages prior to being coupled to the output node. The adjuster may be controlled, for example, based on at least one control signal from a host system, which at least one control signal may set the level of second output voltage of the second LDO stage 60 to one or more corresponding levels for powering, or driving, one or more logic blocks for supporting operation of the host system in various modes. In one embodiment, the at least one control signal for setting the second output voltage level may be based on a user signal.

Controller 80 may control the second LDO stage 60 to generate the second output voltage $V_{2out}$ during one or more operational modes of the host system (or load) and may control the second LDO stage 60 to temporarily block (or scale down) the second output voltage during transition periods between those modes. The second output voltage may be selectively generated in this manner even though, for example, in one embodiment one or more enable signals are supplied to the second LDO stage 60 during the transitional period(s), for example, for purposes of performing a scale down operation as previously mentioned. In other embodiments, the second LDO stage 60 may be disabled during the transitional period(s) and/or based on the requirements of the host system.

Figure 2:
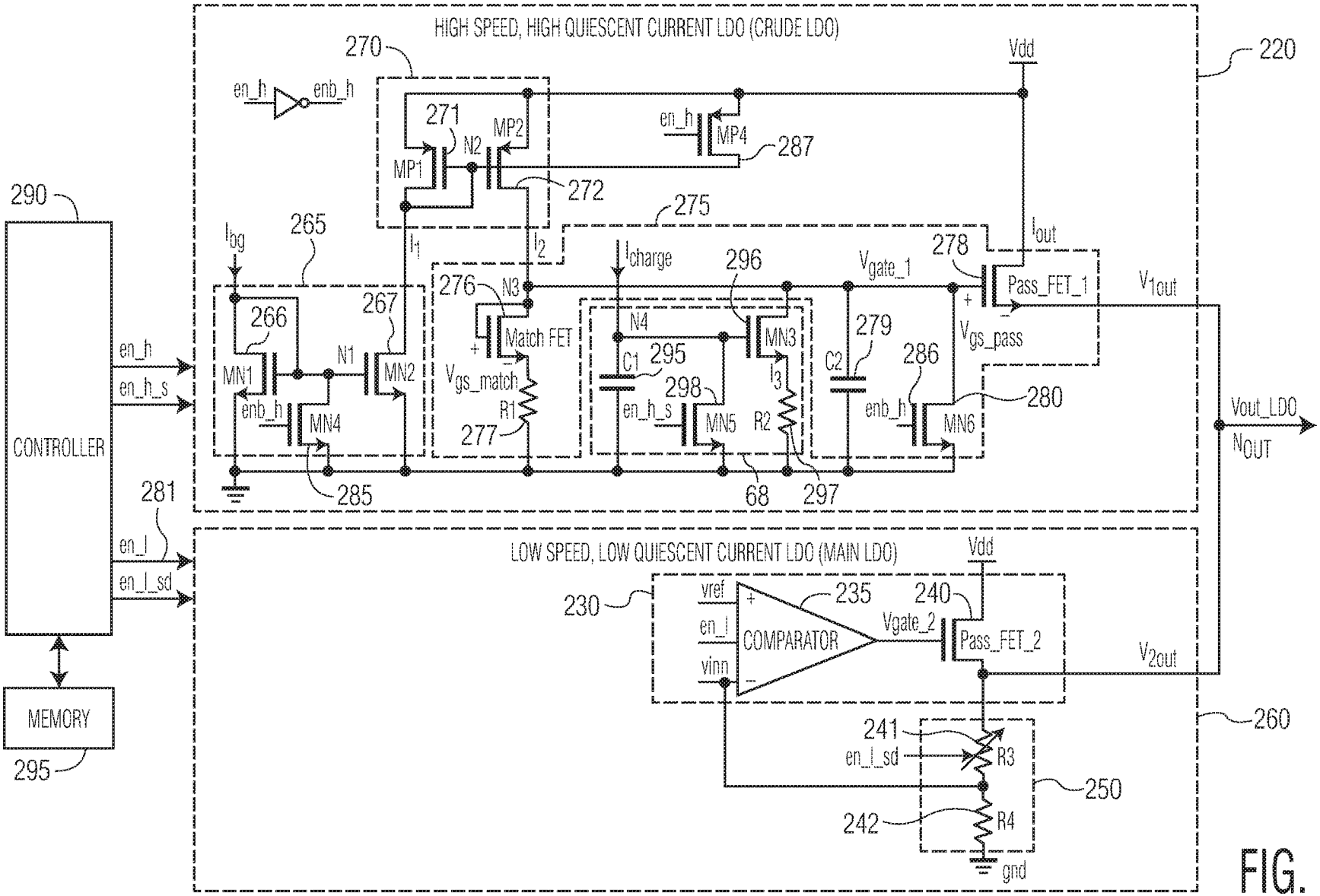
FIG. 2 illustrates an embodiment of a low dropout regulator.

FIG. 2 illustrate embodiments of a first LDO stage 220 and a second LDO stage 260 of the LDO regulator, which, for example, may respectively correspond to the first LDO stage 20 and the second LDO stage 60 in FIG. 1. A controller 290 may generate signals for controlling the operational states of the LDO stages as described herein. The controller 290 may execute instructions stored in memory 295 in order to generate the control signals for selectively controlling the stages of the LDO regulator as described herein. The memory 295 may be a random access memory, a read only memory, and or various specific types of these non-transitory computer-readable media. The controller 290 may correspond, for example, to controller 80 of FIG. 1 or a different controller generating one or more different control signals.

Taking the second LDO stage 260 first, the second LDO stage 260 includes a voltage regulator 230 and a level adjuster 250. The voltage regulator includes a comparator 235 and a pass transistor 240. The comparator may be, for example, an operational amplifier having a non-inverting terminal coupled to receive a predetermined reference voltage (Vref) and an inverting terminal coupled to receive a feedback signal Vinn. The predetermined reference voltage Vref may, for example, correspond to a bandgap reference of the host system. In one embodiment, the reference voltage Vref may serve as an accuracy reference with a first accuracy (e.g., 5%) without calibration and a second accuracy (e.g., 2%) with calibration. The feedback signal Vinn may correspond, for example, to an output of the level adjuster. The pass transistor 240 may be an NMOS transistor that passes supply current from a voltage source Vdd to generate the second output current $V_{2out}$ to power a load in one or more operational modes. In another embodiment, the pass transistor may be a PMOS type of transistor.

The comparator generates a voltage Vgate_2 that controls the gate of the pass transistor 240. The voltage of Vgate_2 may be fixed or may be controlled to one or more levels. In this latter case, the level adjuster may control the value of the input voltage Vinn. The level adjuster may include, for example, a voltage divider including a first resistor ($R_3$) 241 and a second resistor ($R_4$) 242. One of these resistors (e.g., first resistor 241) may be a variable resistor with a value controlled, for example, based on a control signal from the host system and/or a user signal. By varying the value of this resistor, the second output voltage $V_{2out}$ may be adjusted to a level sufficient to meet the requirements of an intended application of the host system during one or more operational modes.

The second LDO stage 260 has a closed-loop regulator topology formed from the comparator and the voltage-divider and uses reference voltage Vref in this embodiment. In one embodiment, the second LDO stage 260 may have an open-loop topology provided, for example, this topology can satisfy requirements of the host system. The second output voltage $V_{2out}$ generated from second LDO stage 260 may be generated based on Equation 1.

$$V_{2out}=V_{ref}*[1+(R_3/R_4)], \quad (1)$$

where $R_3$ corresponds to the variable resistor whose resistance may be adjusted to change the level of the second output voltage. In one embodiment, the resistance value of $R_4$ or the resistance values of both $R_3$ and $R_4$ may be adjusted in order to change the level of the second output voltage.

The controller 290 may enable the second LDO stage 260 by asserting control signal (en_l) 281 and may disable this stage by de-asserting (or inverting) this control signal. The controller 290 may assert control signal (en_l) 281 during one or more operational modes. The operational modes may correspond to a normal mode or one or more low-power modes (e.g., sleep state, hibernate, etc.). One or more of the low power modes may correspond to a case where the host system is required to consume a low amount of current, and in some cases even as low as a few microamps. In order to meet these performance requirements, the second LDO stage 260 may be required to consume a quiescent current as low as a few microamps or even lower.

Figure 3A:
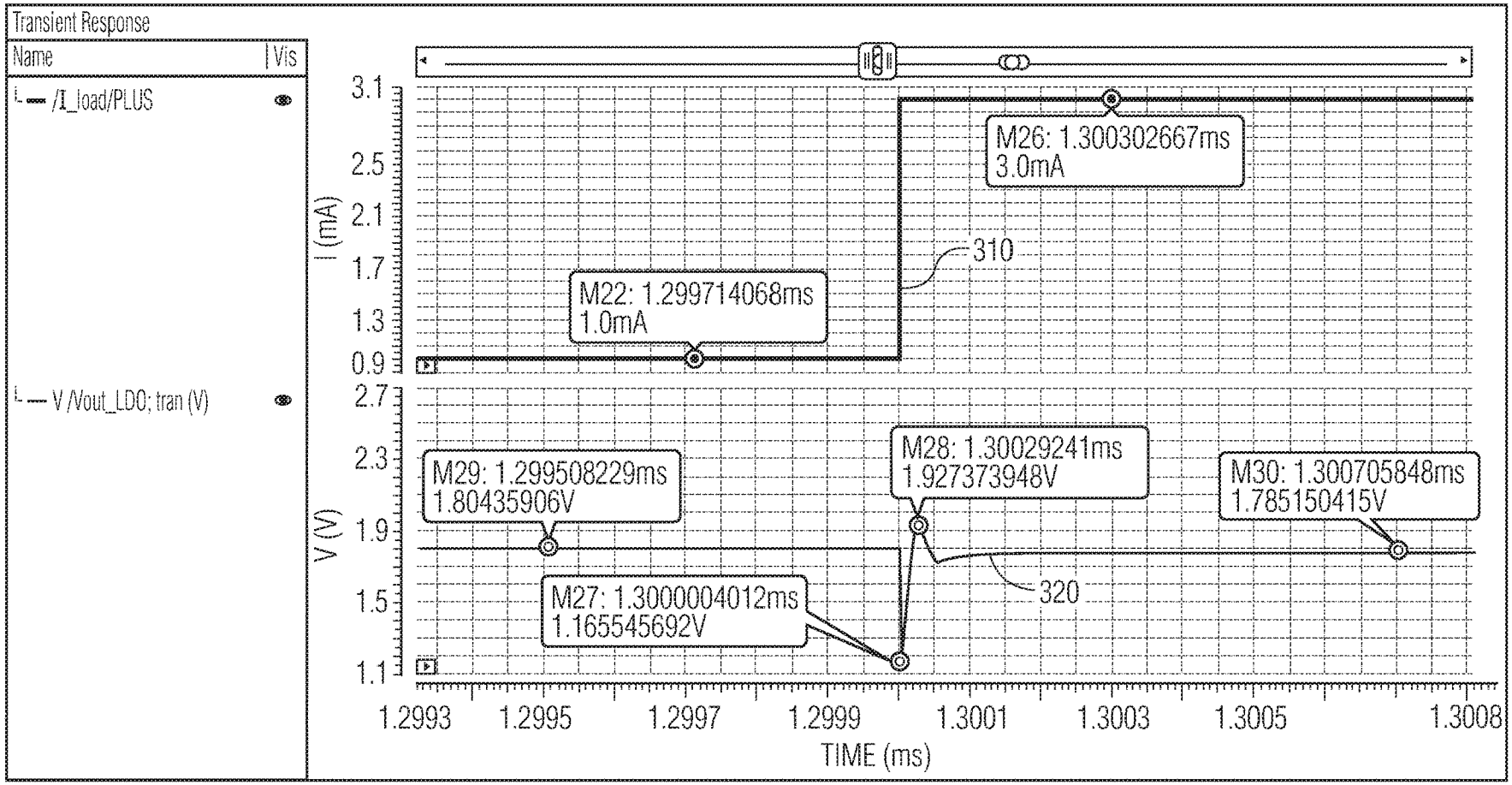
FIGS. 3A and 3B illustrate an examples of overshoot and/or undershoot conditions.

The requirement of low quiescent current may limit the bandwidth (e.g., the speed) of the second LDO stage. The second LDO stage 260 may not have enough speed to respond sufficiently to the large and fast change of load current that is required during a mode transition. This may be understood, for example, by the graph of FIG. 3A, which illustrates two curves 310 and 320 showing that with only the second LDO stage turned on, large voltage undershoot is observed at low as 1.16V when the load current transits from 1 mA to 3 mA within 3 nS. In this example, voltage undershoot is about 35% lower than the typical output value of 1.8V, which is low enough to trigger the host system to reset. Voltage overshoot may also be seen thereafter.

Figure 3B:
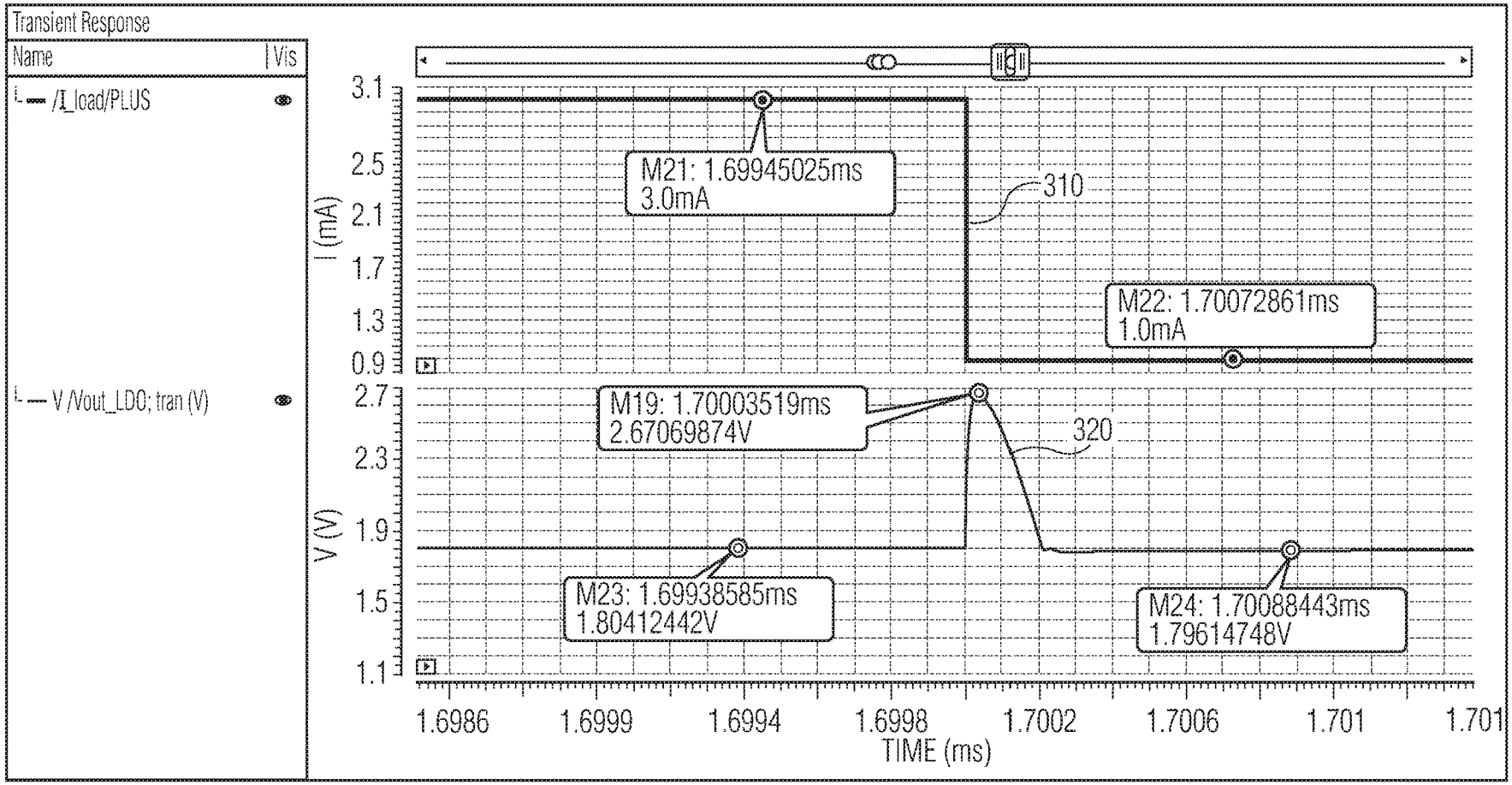

Additional effects of using only the second LDO stage during a mode transition are apparent from FIG. 3B. As illustrated in FIG. 3B, a large voltage overshoot is observed at high as 2.67V when the load current transitions from 3 mA to 1 mA within 3 nS. This overshoot is about 48% higher than the typical output value of 1.8 V of the first LDO stage. These conditions may also cause a failure or other malfunction in the host system (or other load). When en_l is de-asserted, the comparator 235 is disabled, and its output Vgate_2 is pulled down to disable the pass_FET_2 240. When en_l_sd is asserted, $R_3$ 241 is scaled up to a higher value, and $V_{2out}$ is adjusted to a lower value, and vice versa.

In order to compensate for theses malfunctions or the performance degradation that occurs as a result, controller 290 may enable the first LDO stage 220 during a mode transition. Because the first LDO stage 220 has a higher speed and higher quiescent current than the second LDO stage 260, voltage overshoot and/or voltage undershoot may be reduced or prevented, thereby allowing for improved performance during the period(s) of transition between operational modes of the host system. (In one embodiment, the operational modes may include any mode that does not involve a transition period between modes and in this sense any non-transition mode may be referred to as a normal mode.)

Referring again to FIG. 2, the first LDO stage 220 includes a first current source 265, a second current source 270, and a voltage regulator 275. The first current source 265 may include, for example, a first transistor ($MN_1$) 266 and a second transistor ($MN_2$) 267 having gates which are coupled together at node N1 to form a first current mirror circuit. The first transistor 266 is in a first arm of the current mirror and receives an input current $I_{bg}$, which is mirrored in a second arm of the current mirror through the second transistor 267. The current mirror circuit 265 has a first current mirror ratio m and thus the mirrored current $I_1$ output from the first current mirror circuit 265 is proportional to $m*I_{bg}$. In one embodiment, the first current source 265 may be omitted if the host system supplies current $I_1$.

The second current source 270 may include, for example, a first transistor ($MP_1$) 271 and a second transistor ($MP_2$) 272 having gates which are coupled together at node N2 to form a second current mirror circuit. The first transistor 271 is in a first arm of the second current mirror and receives the output current $I_1$ from the first current mirror as its input current. The current $I_2$ is mirrored in a second arm of the second current mirror through the second transistor 272. The current mirror circuit 270 has a second current mirror ratio n and thus the mirrored current $I_2$ output from the second current mirror circuit 270 is proportional to $n*I_1$. The current mirror ratios m and n may be predetermined values that are the same or different from one another. The different conductivity types of the transistors used in the first and second current mirror circuits allow, in part, the first LDO stage to operate in the following manner.

Current $I_{bg}$ may be generated from the chip main bias by using bandgap voltage, $V_{bg}$, divided by a resistor, R and may be can be represented, for example, by Equation 2.

$$I_{bg}=V_{bg}/R, \tag{2}$$

where $V_{bg}$ is an accurate reference voltage and R is a resistor in the bandgap voltage generator to generate $I_{bg}$. R is required to be on the same silicon substrate as $R_1$ 277 so that R and $R_1$ have the same process corner. Therefore $R_1/R$ is a constant number across process, supply voltage and temperature (PVT). The output current $I_1$ from the first current source 265 and the output current $I_2$ from the second current source 270 may be calculated based on Equations 3 and 4, respectively.

$$I_1=I_{bg}*m=(V_{bg}/R)*m \tag{3}$$

$$I_2=I_1*n=(V_{bg}/R)*m*n \tag{4}$$

The voltage regulator 275 includes a matching transistor 276, a resistor ($R_1$) 277, a pass transistor 278, a capacitor 279, and a transistor 280. The matching transistor (Match FET) 276 is coupled to the transistor 272 at node N3. In one embodiment, the matching transistor may be a NMOS transistor connected in a diode-coupled state between resistor 277 and the output of the second current source 270. When current $I_2$ is of sufficient magnitude to forward-bias the matching transistor, the voltage of node N3 is set based on the resistance value of resistor 277 and the voltage drop of the diode connected matching transistor 276. This voltage, which corresponds to Vgate_1, controls the gate signal into the pass transistor 278. Erratic variations in the gate signal Vgate_1, which may produce unstable performance, may be dampened (or otherwise controlled) by the parallel connection of the gate line to capacitor ($C_2$) 279. This capacitor may also operate to filter out spurious (e.g., out-of-band) signals that may be superimposed onto the gate line.

The pass transistor 278 is controlled by the value of the gate signal Vgate_1 output from matching transistor 276. In one embodiment, the pass transistor may have the same conductivity type as the matching transistor. In FIG. 2, both transistors are illustrated as NMOS transistors but these transistors may be PMOS transistors in another embodiment. When the value of gate signal Vgate_1 (which is based on $I_2$) exceeds its threshold voltage, the pass transistor 278 conducts to generate the first output voltage $V_{1out}$ of the first LDO stage based on a current $I_{out}$ derived from voltage source Vdd. The output voltage $V_{1out}$ may be generated based on Equation 5:

$$\begin{aligned} V_{1out} &= I_2 * R_1 + V_{gs_match} - V_{gs_pass} \\ &= (V_{bg} * m * n) * (R_1 / R) + V_{gs_match} - V_{gs_pass} \end{aligned}, \tag{5}$$

where $V_{gs_match}$ is the gate-source voltage of the matching transistor 276 and $V_{gs_pass}$ is the gate-source voltage of the pass transistor (pass FET_1) 2878

In operation, the matching transistor matches voltage $V_{gs_match}$ to voltage $V_{gs_pass}$. In this way, the matching transistor and the voltage drop across $R_1$ effectively controls (or stabilizes) the level of the output voltage of the first LDO stage to be at one or more predetermined levels, for example, depending on the intended application or requirements of the host system. Because of this match operation, the matching transistor and the pass transistor may have the same conductivity type with the same channel length. Also, the ratio of the channel width between the pass transistor and the matching transistor may be as close to the ratio between $I_{out}$ to $I_2$ as possible (e.g., to within a predetermined tolerance) in order to guarantee voltage $V_{gs_match}$ matches voltage $V_{gs_pass}$. When this is the case, Equation 5 may be simplified to Equation 6:

$$\begin{aligned} V_{1out} &= I_2 * R_1 + v_{gs_match} - v_{gs_pass} \\ &= I_2 * R_1 \\ &= (V_{bg} * m * n) * (R_1 / R) \end{aligned} \tag{6}$$

where $R_1/R$, m, and n are constant values based on, for example, design requirements of the host system. In this case, the output voltage $V_{1out}$ of the first LDO stage may be an accurate replica of $V_{bg}$. In some cases, mismatch may exist in the first and second current mirror circuits, between $R_1$ and R, and/or between the matching and pass transistors. To the extent that this is the case, calibration operation may be performed. The calibration operation may involve, for example, changing one or more parameters of the first current mirror circuit 265 and/or the second current mirror circuit 270, and/or adjusting the resistance value $R_1$ in order to improve accuracy.

In one embodiment, in order to guarantee high speed, the value of current $I_2$ may be increased (e.g., by controlling one or both of the current ratios of m or n) to limit the resistance value of $R_1$. This resistance value may be limited in order to maintain the gate of the pass transistor 278 to be a low impedance node. Therefore, during mode transition from low load current to high load current, the first output voltage $V_{1out}$ may start to drop and the internal gate-source capacitance (Cgs) of the pass transistor may be charged fast enough to maintain a constant value of gate voltage of the pass transistor 278. As a result, the gate-source voltage of the pass transistor (Vgs_pass) 278 may be controlled (e.g., to increase) as the first output voltage $V_{1out}$ decreases.

In one embodiment, the load current $I_{load}$ (e.g., the current output from the second LDO stage through node $N_{OUT}$) may be determined based on Equation 7:

$$I_{load}=(1/2)*\mu_n*C_{ox}*(W/L)*(V_{gs_pass}-V_{thn})^2*(1+\lambda*V_{ds_pass}), \tag{7}$$

where $\mu_n$ indicates the mobility of the pass transistor, $C_{ox}$ is the gate oxide capacitance per unit area of the pass transistor, $V_{thn}$ is the threshold voltage of the pass transistor (NMOS) 278, $\lambda$ is a channel-length modulation coefficient of the pass transistor, $V_{gs_pass}$ is the gate-to-source voltage of the pass transistor (that is, $V_{gate_1}-V_{1out}$), and $V_{ds_pass}$ is the drain-to-source voltage of the pass transistor (that is, $Vdd-V_{1out}$). From Equation 7, it is evident that as current $I_{load}$ increases, the first output voltage $V_{1out}$ decreases which then increases voltage $V_{gs_pass}$, the effect of which is to suppress a further increase in voltage $V_{ds_pass}$, thereby reducing or avoiding voltage undershoot.

On the other hand, during mode transition from high load current to low load current, the opposite operation may be performed in order to avoid voltage overshoot at $V_{1out}$. From Equation 7, it is evident that as current $I_{load}$ decreases, the first output voltage $V_{1out}$ increases which then decreases voltage $V_{gs_pass}$ the effect of which is to suppress a further decrease in voltage $V_{ds_pass}$, thereby reducing or avoiding voltage overshoot.

In order to maintain low impedance, the gate of the pass transistor 278 is coupled to capacitor ($C_2$) 279. The capacitance value of $C_2$ may be selected, for example, based on limitations of the silicon area occupied by the pass transistor.

In addition to the aforementioned features, the first LDO stage 220 may include transistor ($MN_4$) 285, transistor 286 ($MN_6$), and transistor 287 ($MP_4$). These transistors may be small-switch devices with gates coupled to receive enable signals for controlling aspects of the operation of the first LDO stage. For example, transistors 285 and 286 are controlled based on the complement of an enable signal enb_h and transistor 287 is controlled based on enable signal en_h. In the case where transistors 285 and 286 are NMOS transistors and transistor 287 is a PMOS transistor, a logical zero value of enable signal en_h will shut off the first current source 265 and the voltage regulator 275 and the logical one value of the complement of this enable signal will shut off the second current source 270. As a result, the first LDO stage will be disabled based on these logical values. Conversely, the first LDO stage will be enabled based on opposite logical values of en_h and enb_h. Thus, transistors 285, 286, and 287 may be considered to in a shut-down circuit of the first LDO stage.

In addition to the shutdown circuit, the first LDO stage 220 may include a soft shutdown circuit 68 that includes capacitor ($C_1$) 295, transistor ($MN_3$) 296, resistor ($R_2$) 297, and transistor ($MN_5$) 298. The transistor 296 is coupled between the gate line of the pass transistor and a reference potential through resistor $R_2$. The transistor 298 is coupled between the gate line of transistor 296 and the ground reference potential, and the capacitor 295 is coupled between a node N4, that receives a charging current $I_{charge}$, and the ground reference potential. In operation, node N4 couples one portion of this charging current to the gate of transistor 296 and the drain of transistor 298 and another portion of the charging current for charging capacitor 295.

The soft shutdown circuit 68 may control shutdown of the second LDO stage at a rate slower than the shutdown circuit. The rate may be based, for example, on the charging time of capacitor ($C_1$) 295. For example, when transistor 298 is turned on, the soft shutdown circuit 68 is disabled based on a first logical value of enable signal en_h_s. When transistor 298 is turned off based on a second logical value of disable signal en_h_s, the charging current $I_{current}$ begins to charge the capacitor 295. As the capacitor 295 charges, the gate voltage of transistor 296 reaches its threshold voltage at a point in time. At this time point, the transistor 296 conducts and current $I_3$ flows through resistor 297 to gradually pull down the gate voltage of the pass transistor, thereby slowly reducing or shutting off the first output voltage $V_{1out}$ of the first LDO stage.

Figure 4:
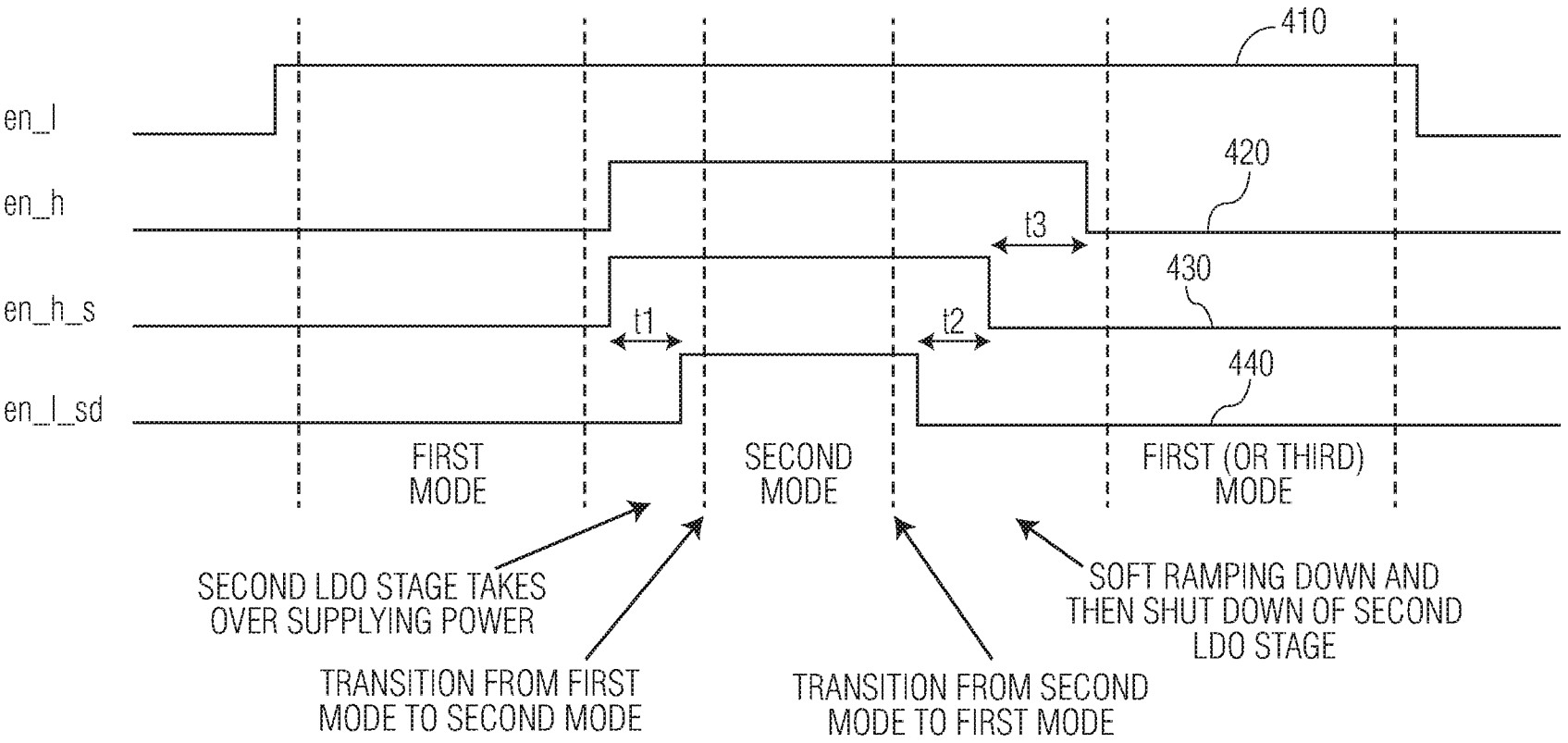
FIG. 4 illustrates an embodiment of control signals for a low dropout regulator.

FIG. 4 illustrates an embodiment of a timing diagram for controlling the parallel stages of the LDO regulator of FIG. 2. The timing diagram is partitioned into a periods of time that sequentially include a first mode of operation, a first mode transition, a second mode of operation, a second mode transition, and the first mode of operation. The first and second modes may be, for example, modes of a host system or other load. During each of the designated time periods, the controller 290 controls the values of various combinations of (enable) signals to selectively control the first and second stages of the LDO regulator. Reference numerals 410, 420, 430, and 440 are waveforms that corresponding to respective ones of the control signals.

Referring to FIG. 4, prior to the first mode, the LDO regulator operates in an initial mode where all of the control signals have a first logical value, which, for example, may be a logical zero value based on the logic used in the regulator of FIG. 2. The controller 290 changes the control signals from the first logical value to a complementary second logical value at selected times, as described herein. In another embodiment, the logical values of the control signals may be different, for example, based on using different transistor logic to implement the LDO regulator. The control signals may include a first control signal (en_l) for enabling the second LDO stage, a second control signal (en_h) for enabling the first LDO stage, a third control signal (en_h_s) for controlling a soft shutdown of the first LDO stage, and a fourth control signal (en_l_sd). These control signals are illustrated as inputs to various transistors of FIG. 2.

In the first mode (first occurrence), first control signal (en_l) transitions to a logical one value and the remaining control signals have a logical zero value. As a result, the second LDO stage 260 is enabled and the first LDO stage is disabled, and the output voltage (Vout_LDO) of the LDO regulator is based on the output voltage $V_{2out}$ of the second LDO stage. The first mode may be any operational mode of the host system. For illustrative purposes, the first mode is illustrated as normal mode, e.g., a normal-power mode. In other embodiments, normal mode may be considered, for example, to be one of a plurality of reduced power modes.

In the first mode transition period (second occurrence), the second control signal (en_h) and third control signal (en_h_s) are controlled to be logical one values along with the first control signal (en_l). The fourth control signal (en_l_sd) remains low at this time. As a result, the second LDO stage remains on and the first LDO stage 220 is enabled as a result of the logical one value of the second control signal (en_h) and the logical one value of the third control signal (en_h_s), which operates to deactivate the shutdown circuit 68 by coupling the gate of transistor $MN_3$ 296 to ground. At this point, the first LDO stage generates its output $V_{1out}$, which is coupled to node $N_{OUT}$ along with the output $V_{2out}$ of the second LDO stage. Thus, for a short period of time, the output voltage of the LDO regulator is based on whichever one is higher, e.g., Vout_LDO=max ($V_{2out}$, $V_{1out}$).

Also, after a settling time $t_1$ in the first mode transition period, the fourth control signal (en_l_sd) transitions to a logical one value, e.g., at this time all four control signals have a logical one value. The logical one value of the fourth control signal controls the second LDO stage to scale down its output voltage $V_{2out}$ by increasing the value of $R_3$ 241 to a predetermined value.

The predetermined value is a value much lower than the output voltage $V_{1out}$ of the first LDO 220, so that pass_FET_2 240 is shut down by the output of the comparator 235 and the first LDO takes over the power supplying as described as the following paragraphs. The purpose in this transition from first mode to second mode is the first LDO to take over supplying the power.

In one embodiment, the reference voltage Vref into the comparator 235 may be represented by equation 8, which can be derived from Equation 1.

$$V_{ref}=V_{2out}*[1+(R_3/R_4)] \tag{8}$$

In this case, the feedback voltage Vinn may be based on Equation 9. Therefore, in view of these equations, during the first mode transition $V_{inn}>V_{ref}$ and $V_{gate_2}$ will be pulled down to ground by the comparator. As a result, the pass transistor will be turned off. Then, the output voltage $V_{1out}$ of the first LDO stage takes over to supply power to the host system.

$$V_{inn}=V_{1out}*[1+(R_3/R_4)] \tag{9}$$

In one embodiment, depending on the requirements of the host system, instead of asserting the fourth control signal (en_l_sd) to scale down the output voltage $V_{2out}$ of the second LDO stage from the pass transistor, another option is de-asserting the first control signal (en_l) to fully disable the second LDO stage. In this case, the second LDO stage may be re-enabled (by re-asserting en_l) after the host system transitions back to the next mode or the previous mode of operation. As a result of the output voltage $V_{1out}$ of the first LDO stage taking over supplying power to the host system during the mode transition period, the parallel LDO stages have sufficiently high enough speed to respond to the mode transition, because of the high-speed design of the first LDO stage. Put differently, by controlling the logical values of the control signals in the aforementioned manner, the transition to the second mode may be performed with sufficient speed and power to prevent a voltage overshoot condition and a voltage undershoot condition from occurring.

In the second mode, the states of all four control signals may remain unchanged, e.g., at the logical one value. By keeping all of the enable signals the same, the output voltage of the first LDO stage dominates the LDO regulator output. In the second mode, the output voltage of the first LDO must be designed to be higher than the scaled down output voltage of the second LDO in order for the first LDO to dominate the LDO regulator output. As described above, $V_{2out}$ is scaled down or LDO 260 is shut down to guarantee that LDO 220 dominates the LDO regulator output so that, $V_{1out}>V_{2out}$.

In the second transition mode (e.g., from the second mode back to the first mode), the fourth control signal (en_l_sd) transitions to a logical zero value. This shuts off the scale down of the output voltage of the second LDO stage. Then, after a period $t_2$, the third control signal (en_h_s) transitions to a logical zero value, the effect of which is to perform a soft shutdown of the first LDO stage. Then, after another period $t_3$, the second control signal (en_h) transitions to a logical zero value, thereby shutting off the first LDO stage. As a result, because the first control signal (en_l) remained at a logical one value and the scale down circuit of the second LDO stage has been shut off, the output voltage $V_{2out}$ of the second LDO stage controls once again the output voltage (Vout_LDO) of the LDO regulator.

By controlling transitions of the second, third, and fourth control signals in this stepwise manner, the controller may control the transition back to the first mode (or a third mode) with sufficient speed and power to prevent a voltage overshoot condition and a voltage undershoot condition from occurring.

Instead of transmitting from the second mode back to the first mode, in one embodiment the transition may be performed from the second mode to a third mode, which, for example, may correspond to another mode of operation of the host system, e.g., a reduced power mode or another type of mode.

Operation of the soft shutdown circuit 68 may be more fully explained during mode transition as follows. As illustrated in FIG. 4, during the transition from the second mode to the first mode and before the first LDO stage is turned off by de-assertion of control signal en_h, a soft ramp down operation of the output voltage $V_{1out}$ of the first LDO stage is performed. When both of the en_h and en_h_s control signals have a logical one value, the gate voltage of transistor $MN_3$ is pulled down as a result of transistor $MN_5$ being turned on. This causes transistor $MN_3$ to turn off and the voltage stored in capacitor $C_1$ to discharge to ground through transistor $MN_5$. Current derived from $I_{charge}$ may also pass through $MN_5$ to ground.

Additionally, when control signal en_h still has a logical one value and control signal en_h_s is toggled from logic high to low during this period, transistor $MN_5$ is turned off and current $I_{charge}$ charges $C_1$. This causes the gate voltage of transistor $MN_3$ to ramp up to a level sufficient to turn on transistor $MN_3$. Ramping up the gate voltage of transistor $MN_3$ causes the source voltage of transistor $MN_3$ and current $I_3$ to increase. Therefore, the current passing through resistor $R_2$ increases, and the current passing through resistor $R_1$ decreases. As a result, the gate voltage of the pass transistor decreases, which, in turn, causes the output voltage of the second LDO stage $V_{1out}$ to decrease.

Thus, by controlling the value of current $I_{charge}$ and the voltage of capacitor $C_1$, a soft ramping down operation for the gate voltage of the pass transistor $V_{gate_1}$ may be performed. This controls the output voltage $V_{1out}$ of the first LDO stage. Moreover, resistor $R_2$ may be coupled to the source of transistor $MN_3$ in what may effectively be a source degeneration topology, which uses transistor $MN_3$ to smooth out the increase of current $I_3$. In one embodiment, resistor $R_2$ is coupled between node $N_3$ and the drain of transistor $MN_3$. In this case, a soft shutdown operation may be performed. Current $I_{charge}$ may be generated, for example, locally from the internal current mirrors of the LDO regulator or may be provided from the host system. The first LDO stage has an open-loop topology. In another embodiment, the first LDO stage may have a closed-loop topology.

Figure 5:
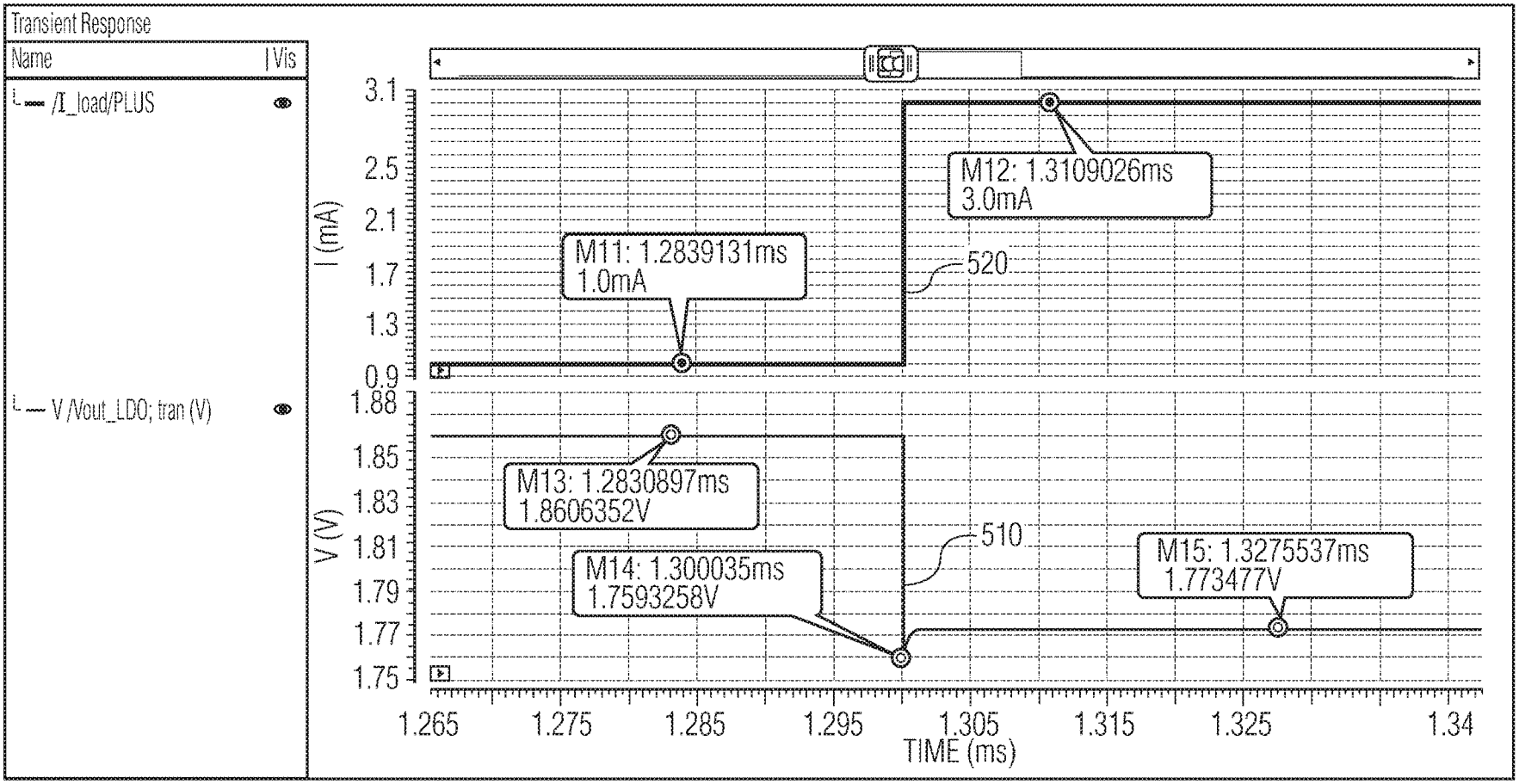
FIG. 5 illustrates examples of simulation results in accordance with one or more embodiments.

FIG. 5 is a graph illustrating an example of simulation results for one or more of the aforementioned embodiments. In this graph, curves are shown that exhibit performance of the LDO regulator when the first mode transition occurs (from low load current to high load current) as previously described. The voltage curve 510 shows the performance of the regulator output (Vout_LDO) and current curve 520 shows the performance of the load current ($I_{LOAD}$) of the regulator. As shown by these curves, both voltage overshoot and voltage undershoot are avoided during a mode transition period as a result of activating the first LDO stage, as described herein.

Figure 6:
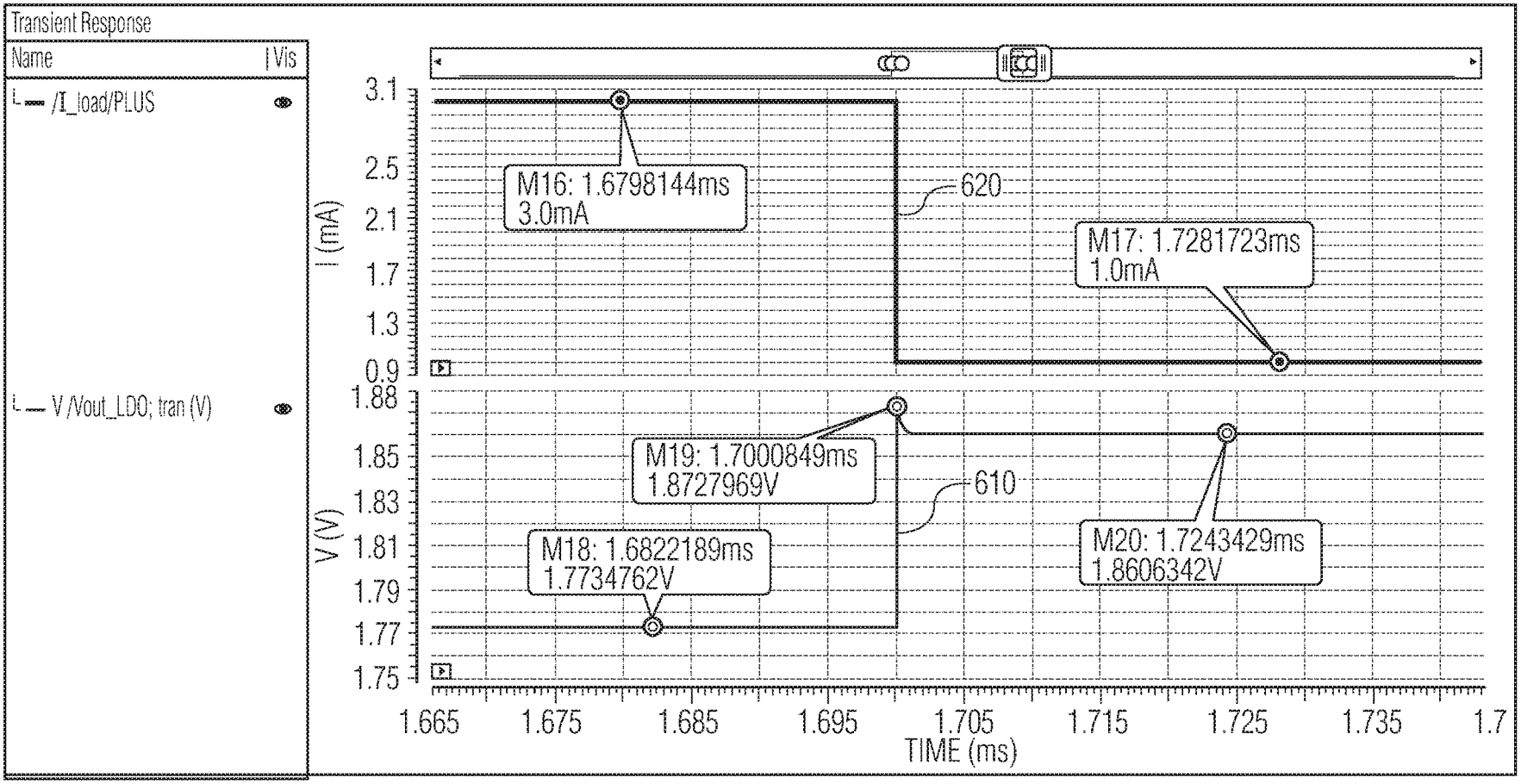
FIG. 6 illustrates examples of simulation results in accordance with one or more embodiments.

FIG. 6 is a graph illustrating an example of additional simulation results for one or more of the aforementioned embodiments. In this graph, curves are shown that exhibit performance of the LDO regulator when the second mode transition occurs (from high load current to low load current) as previously described. The voltage curve 610 shows the performance of the regulator output (Vout_LDO) and current curve 620 shows the performance of the load current ($I_{LOAD}$) of the regulator. As shown by these curves, both voltage overshoot and voltage undershoot are avoided during a mode transition period as a result of activating the first LDO stage, as described herein. In FIGS. 5 and 6, in some cases voltage variations are still possible during mode transitions. However, the variations are much smaller and within acceptable range, e.g., +/−10% of typical value.

In some embodiments, after transition from the second mode back to the first mode, the first LDO stage may be turned off completely in order to satisfy low power consumption requirements. Because of the low-power and low-speed design of the second LDO stage, a soft shutdown operation may be performed for the first LDO stage to provide enough time for the second LDO stage to take over the supply of power during the first operational mode. As previously described, this may be accomplished, first, by de-asserting control signal en_h_s to allow the output voltage of the first LDO stage $V_{1out}$ to ramp down. During ramping down of the output voltage $V_{1out}$ of the first LDO stage, the pass transistor (pass FET_2) of the second LDO stage may be turned on and the second LDO stage takes over supplying power to the host system (e.g., load). Then, control signal en_h may be de-asserted to fully turn off the first LDO stage.

Figure 7:
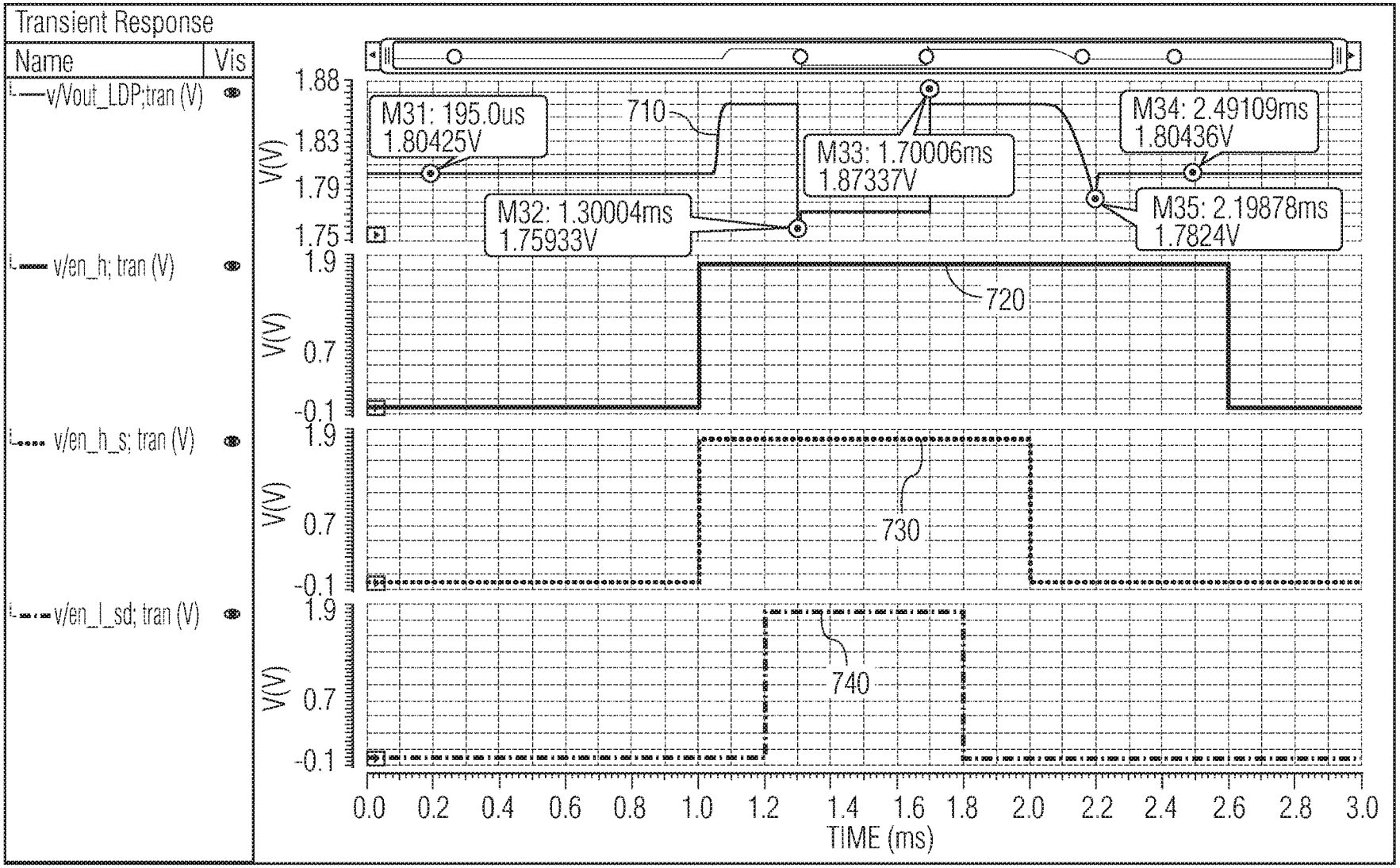
FIG. 7 illustrates examples of simulation results in accordance with one or more embodiments.

FIG. 7 is a graph illustrating an example of simulation results of the output voltage of the LDO regulator. In this graph, curve 710 corresponds to the output voltage $V_{out_LDO}$ of the LDO regulator, curve 720 corresponds to control signal en_h, curve 730 corresponds to control signal en_h_s, and curve 740 corresponds to control signal en_l_sd. As can been seen, the changing values of the control signals selectively activate the parallel connection of LDO stages over a predetermined time sequence. This selection activation, as previously described, prevents large voltage overshoot and large voltage undershoot conditions from occurring, even when variations occur in the output voltage of the LDO regulator within a predetermined acceptable range.

In accordance with one or more of the aforementioned embodiments, an LDO regulator is provided with two LDO stages coupled in parallel, where each stage outputs different voltage levels and operates based on different speeds and quiescent currents. The LDO stages are selectively controlled to reduce or prevent voltage undershoot and/or voltage overshoot that may occur during transitions between operating modes of a load, which, for example, may be a host system of the LDO regulator. Selective control of the LDO stages ensures a smooth switchover from one mode to another, in a manner that prevents resets or other host circuit malfunctions from occurring. The arrangement also ensures low power consumption during the operational modes.

The controllers, processors, voltage adjusters, voltage regulators, comparators, current generators, and other signal-generating and signal-processing features of the embodiments disclosed herein may be implemented in logic which, for example, may include hardware, software, or both. When implemented at least partially in hardware, the controllers, processors, voltage adjusters, voltage regulators, comparators, current generators, and other signal-generating and signal-processing features may be, for example, any one of a variety of integrated circuits including but not limited to an application-specific integrated circuit, a field-programmable gate array, a combination of logic gates, a system-on-chip, a microprocessor, or another type of processing or control circuit. Further, it is noted that R and $R_1$ will be on the same chip so that $R_1/R$ is constant across variations in process, voltage supply, and temperature (PVT).

When implemented in at least partially in software, the controllers, processors, voltage adjusters, voltage regulators, comparators, current generators, and other signal-generating and signal-processing features may include, for example, a memory or other storage device for storing code or instructions to be executed, for example, by a computer, processor, microprocessor, controller, or other signal processing device. The computer, processor, microprocessor, controller, or other signal processing device may be those described herein or one in addition to the elements described herein. Because the algorithms that form the basis of the methods (or operations of the computer, processor, microprocessor, controller, or other signal processing device) are described in detail, the code or instructions for implementing the operations of the method embodiments may transform the computer, processor, controller, or other signal processing device into a special-purpose processor for performing the methods described herein.

The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

Although the various exemplary embodiments have been described in detail with particular reference to certain exemplary aspects thereof, it should be understood that the invention is capable of other example embodiments and its details are capable of modifications in various obvious respects. As is readily apparent to those skilled in the art, variations and modifications can be affected while remaining within the spirit and scope of the invention. The embodiments may be combined to form additional embodiments. Accordingly, the foregoing disclosure, description, and figures are for illustrative purposes only and do not in any way limit the invention, which is defined only by the claims.

We claim:

1. A low dropout regulator, comprising:

a first stage configured to generate a first output voltage; and a second stage configured to generate a second output voltage different from the first output voltage, wherein the first stage and the second stage are coupled in parallel to a node, wherein the first stage configured to be selectively controlled to generate the first output voltage based on a first condition;

wherein the second stage configured to be selectively controlled to generate the second output voltage based on a second condition different from the first condition;

wherein the second output voltage is reduced during a mode transition so that the first output voltage is greater than the second output voltage;

wherein the first stage is configured to operate at a first speed and based on a first quiescent current;

wherein the second stage is configured to operate at a second speed and based on a second quiescent current; and wherein the first speed different from the second speed and the first quiescent current different from the second quiescent current.

2. The low dropout regulator of claim 1, wherein the first output voltage is in a range that reduces voltage overshoot in a signal output from the node.

3. The low dropout regulator of claim 1, wherein the first output voltage is in a range that reduces voltage undershoot in a signal output from the node.

4. The low dropout regulator of claim 1, wherein:

the first condition includes a transition between a first mode and a second mode of a load coupled to the node, and the second condition includes operation of the load during at least one of the first mode and the second mode.

5. The low dropout regulator of claim 4, wherein:

the first stage is configured to be selectively controlled to generate the first output voltage during the transition based on a first set of control signal values, and the second stage is configured to be selectively controlled to generate the second output voltage during each of the first mode and the second mode based on a second set of control signal values.

6. The low dropout regulator of claim 5, wherein the first mode and the second mode correspond to different operational modes of a load.

7. The low dropout regulator of claim 4,
wherein at least one of the first mode and the second mode is a reduced power mode.

8. The low dropout regulator of claim 1, wherein:
the first speed is greater than the second speed, and
the first quiescent current is greater than the second quiescent current.

9. The low dropout regulator of claim 1,
wherein the first stage includes a soft shutdown circuit which is configured to reduce a level of the first output voltage based on operation of the second stage.

10. An apparatus for controlling a low dropout voltage (LDO) regulator including a first stage and a second stage, the first state and the second stage coupled to an output node, the apparatus comprising:
a memory configured to store instructions; and
a processor configured to execute the instructions to generate:
one or more first control signals to cause the first stage to generate a first output voltage based on a first condition,
one or more second control signals to cause the second stage to generate a second output voltage based on a second condition,
wherein the second output voltage different from the first output voltage;
wherein the second output voltage is reduced during a mode transition so that the first output voltage is greater than the second output voltage;
wherein the first stage is configured to operate at a first speed and based on a first quiescent current;
wherein the second stage is configured to operate at a second speed and based on a second quiescent current; and
wherein the first speed different from the second speed and the first quiescent current different from the second quiescent current.

11. The apparatus of claim 10,
wherein the first output voltage is in a range that reduces voltage overshoot in a signal output from the node.

12. The apparatus of claim 10,
wherein the first output voltage is in a range that reduces voltage undershoot in a signal output from the node.

13. The apparatus of claim 10, wherein:
the first condition includes a transition between a first mode and a second mode of a load coupled to the node, and
the second condition includes operation of the load during at least one of the first mode and the second mode.

14. The apparatus of claim 13, wherein:
the one or more first control signals control the first stage to generate the first output voltage during the transition, and
the one or more second control signals control the second stage to generate the second output voltage during each of the first mode and the second mode.

15. The apparatus of claim 14,
wherein the first mode and the second mode correspond to different operational modes of a load.

16. The apparatus of claim 15,
wherein at least one of the first mode and the second mode is a reduced power mode.

17. The apparatus of claim 10, wherein:
the first speed is greater than the second speed, and
the first quiescent current is greater than the second quiescent current.

18. The apparatus of claim 10,
wherein the processor is configured to generate control signals for controlling a soft shutdown circuit of the first stage.

19. A low dropout voltage regulator, comprising:
a first stage configured to generate a first output current; and
a second stage configured to generate a second output current, different from the first output current;
wherein the first stage and the second stage are coupled in parallel to a node;
wherein the second output current is reduced in response to a mode transition so that the first output current is greater than the second output current;
wherein the first stage is configured to operate at a first speed and based on a first quiescent current;
wherein the second stage is configured to operate at a second speed and based on a second quiescent current; and
wherein the first speed different from the second speed and the first quiescent current different from the second quiescent current.

* * * * *